US005335865A

United States Patent [19]

Kohler et al.

[11] Patent Number: 5,335,865

[45] Date of Patent: Aug. 9, 1994

[54] TWO-STAGE VARIABLE INTENSITY REFINER

[75] Inventors: Gregory R. Kohler, Williamsport, Pa.; William F. Lahner, III, Graz; Heinrich F. Munster, Vienna, both of Austria; Karl T. G. Dahlqvist, Norrkoping, Sweden

[73] Assignee: Andritz Sprout-Bauer, Inc., Muncy, Pa.

[21] Appl. No.: 904,856

[22] Filed: Jun. 26, 1992

[51] Int. Cl.[5] ..... B02C 7/04

[52] U.S. Cl. ..... 241/28; 241/261.2; 241/261.3

[58] Field of Search ..... 241/28, 244, 261.2, 241/261.3

[56] References Cited

U.S. PATENT DOCUMENTS

| | | | |
|---|---|---|---|
| 2,864,562 | 12/1958 | Eberhardt et al. . | |
| 3,441,227 | 4/1969 | Fisher . | |
| 3,790,092 | 2/1974 | Reinhall . | |
| 4,039,154 | 8/1977 | Peterson | 241/261.3 |
| 4,090,672 | 5/1978 | Ahrel | 241/261.3 X |
| 4,253,613 | 3/1981 | Reinhall | 241/261.2 X |
| 4,253,857 | 3/1981 | Fisher . | |
| 4,269,365 | 5/1981 | Berggren . | |
| 4,283,016 | 8/1981 | Reinhall . | |
| 4,355,767 | 10/1982 | Johansson et al. | 241/244 |
| 4,378,092 | 3/1983 | Reinhall . | |
| 4,676,440 | 6/1987 | Perkola | 241/261.3 |
| 4,725,336 | 2/1988 | Fisher . | |
| 4,878,997 | 11/1989 | Reinhall | 241/261.3 X |
| 4,921,400 | 5/1990 | Niskanen . | |
| 5,042,726 | 8/1991 | Reinhall | 241/261.3 X |
| 5,167,373 | 12/1992 | Bohn et al. | 241/28 |
| 5,248,099 | 9/1993 | Lahner et al. . | |

FOREIGN PATENT DOCUMENTS

| | | | |
|---|---|---|---|
| 2442627 | 3/1975 | Fed. Rep. of Germany | 241/244 |
| 3047109 | 9/1981 | Fed. Rep. of Germany | 241/244 |
| 2183928 | 12/1973 | France | 241/244 |
| 250852 | 6/1987 | Japan . | |
| WO88/03189 | 5/1988 | PCT Int'l Appl. . | |
| 2083375 | 3/1982 | United Kingdom | 241/261.2 |

OTHER PUBLICATIONS

Low Frequency Refining–A New Way To Make Mechanical Pulp (Johan Gullichsen) pp. 320–342 (Source and date unknown).

*Primary Examiner*—Mark Rosenbaum
*Assistant Examiner*—Frances Chin Han
*Attorney, Agent, or Firm*—Chilton, Alix & Van Kirk

[57] ABSTRACT

A high consistency pulp refiner of the type having a pressurized casing (12) containing opposed grinding discs (14,18) mounted for counter-rotation about a common axis (26) and between which material to be refined is introduced near the axis so as to move generally radially outwardly through an inner refining zone (40) between the discs while producing steam as a result of the refining action. The partially refined material and steam then move through a generally radially outer refining zone (50) between one of the discs (14) and a stationary grinding surface (54) situated generally radially outwardly of the other disc (18), whereupon the refined material and steam are discharged from the casing through a material outlet (62). A generally axially extending flow path (64) originates between the first refining zone (40) and the second refining zone (50), for diverting steam produced in the first refining zone away from the second refining zone while the partially refined material moves from the first refining zone to the second refining zone.

11 Claims, 3 Drawing Sheets

TWO-STAGE VARIABLE INTENSITY REFINER

BACKGROUND OF THE INVENTION

The present invention relates to high consistency disc refiners, and more particularly, to disc refiners which have confronting, counter-rotating discs defining two distinct refining zones therebetween.

In the field of rotating disc-type pulp refiners, a known refiner construction includes opposed, counter-rotating discs between which material, such as pulp, is introduced near the axis of rotation, and undergoes defibration as the material moves radially outwardly until discharged at the circumferential periphery of the discs. The defibration, or refining, of the fiber at high consistency produces considerable amounts of steam, which has two detrimental effects. First, the steam tends to carry the fiber radially outward to be discharged from between the discs, before refining has been completed. In other words, the steam generation tends to decrease the dwell time of the fiber in the refining zone between the discs. Secondly, the steam generated in the refining zone tends to push the discs axially apart, and therefore requires that the refining equipment produce a counter-thrust to maintain the gap between discs within a range that achieves defibration. The counter-thrust cannot be so great, however, to induce contact between the discs, which, due to the high rotation speeds, can damage the equipment and result in prolonged outages.

U.S. Pat. No. 4,283,016, issued Aug. 11, 1981 to Reinhall, discloses a method and apparatus for controlling the effect of centrifugal force on the pulp of a double disc defibrating apparatus. The grinding space includes a central portion, a first grinding zone defined between first and second rotating grinding discs and extending outwards from the central portion, and a second grinding zone extending angularly from the outer end of the first grinding zone and being defined between one of the rotatable grinding discs and a stationery grinding surface. Pulp stock to be ground is introduced into the central portion and accelerated through the first and second grinding zones by centrifugal force generated by the rotating discs. The angular second grinding zone serves to retard centrifugal force acting on the pulp in the second grinding zone to increase the dwell time of the pulp in the grinding space for achieving optimum refining efficiency.

The apparatus disclosed in the Reinhall patent is concerned primarily with retarding the flow of pulp in the refining zones, as a counter measure to the increase in centrifugal force associated with the increasing diameter of modern discs. Reinhall does not, therefore, address the effects on the refining process and apparatus, of the considerable amounts of steam generated in the refining zone.

Summary of the Invention

It is, accordingly, an object of the present invention to provide an improved method and apparatus for controlling the refining intensity in a high consistency double disc refiner, by the removal of steam between distinct refining zones.

This general object is achieved in accordance with the apparatus embodiment of the invention, by providing, in a double disc refiner having distinct, radially inner and radially outer refining zones, means, preferably an annular passageway, situated between the first refining zone and the second refining zone, for removing steam produced in the first refining zone while the material to be refined moves from the first refining zone to the second refining zone.

Preferably, refining intensity is controlled in part by adjusting the pressure in a bypass channel having one end in the steam separation region between the first and second refining zones, such that a controlled quantity of steam is drawn substantially axially from the separation region into a dedicated conduit for discharge outside the casing. The partially refined fibers in the separation region, being heavier than the steam and thus less affected by the reduced pressure in the bypass conduit, continue to move substantially radially from the separation region into the inlet of the second refining zone, for further defibration and eventual discharge from the casing through the fiber outlet.

Another preferred aspect of refiner intensity control, is the counter-rotation of the refiner discs, at different equilibrium speeds.

These additional aspects of refining intensity control—steam removal rate and different speed of counter-rotation—are preferably in addition to conventional control techniques such as adjustment of refining gap, and the selective spraying of water at key locations between the discs.

In general, the inventive method is implemented in a high consistency pulp refiner of the type having a pressurized casing containing opposed grinding discs mounted for counter-rotation about a common axis and between which material to be refined is introduced near the axis so as to move radially outwardly as it is refined and generates steam. The material first moves through an inner refining zone between the discs while producing steam, and then through an outer refining zone situated between one of the discs and a static grinding surface situated radially outwardly of the other disc, from which it is discharged from the casing through an outlet. The improved method comprises the step of removing from the casing, at least some of the steam generated in the first refining zone, before that steam enters the second refining zone.

Preferably, the method also includes the step of rotating the discs at different steady state speeds, for example, 1500 rpm and 3000 rpm.

In accordance with the present invention, high quality pulp from wood chips can be obtained with a single pass through a double-disc refiner, by passing the material to be refined through two refining stages or zones. The first, radially inner stage applies a proportionally small amount of energy at a high intensity to the fiber and the second, radially outer stage applies a proportionally larger amount of energy to the fiber, but at a lower intensity level. Thus, both the first stage and second stage refining within a single casing, avoids the necessity for the user to purchase and operate two distinct refiners. Also, a mill can obtain the benefits of dual intensity refining while avoiding the need to operate and maintain two distinctly different types of refiners.

The present invention, while appearing in overall construction as a double-disc refiner, actually combines the advantage of the counter-rotating discs of the first stage to provide the high intensity refining, while taking advantage of an effective single disc type of second stage for lower intensity fiber development. This hybrid construction is further enhanced by steam separation between refining zones, preferably with the capability to adjust the different speeds of rotation of the discs. Significant decreases in energy consumption for a given degree of refining are achieved by operating the control disc at increased speeds relative to the feed disc. The steam separation between refining zones assists fiber flow and reduces the required refining thrust.

BRIEF DESCRIPTION OF THE DRAWINGS

These and other objects and advantages of the invention are described in the context of the preferred embodiment, with reference to the accompanying drawings, in which.

DESCRIPTION OF THE PREFERRED EMBODIMENT

Figure 1:
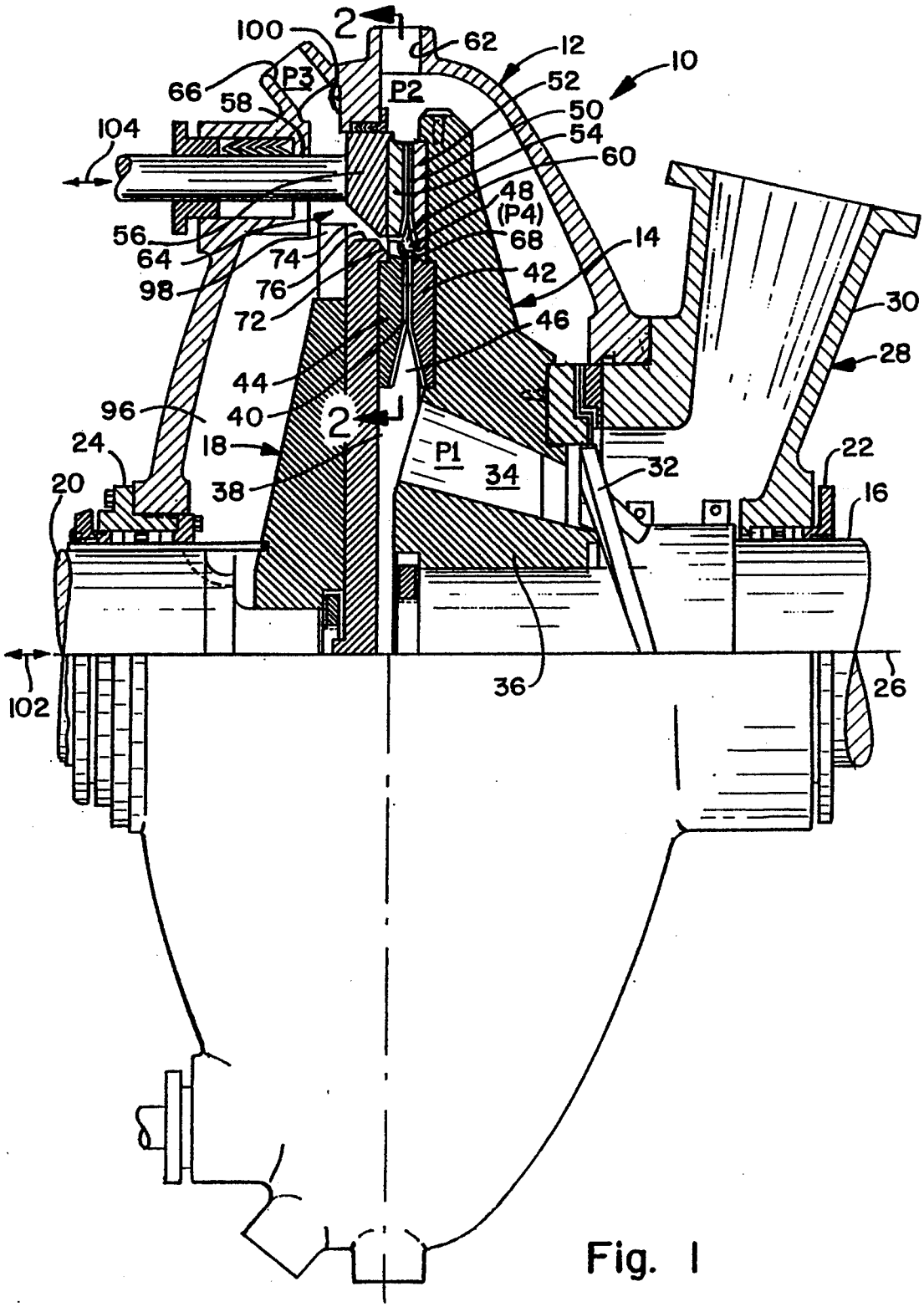
FIG. 1 is a partially sectioned view of a double disc refiner showing the portion of the refiner containing the two refining zones and associated steam removal path, in accordance with the present invention.

FIG. 1 is a sectional view of one-half of a portion of a so-called double disc refiner 10, illustrating the preferred embodiment of the present invention. In these types of refiner 10, a casing 12 containing a first, or feed end disc 14, driven by first shaft 16, confronts a second, or control end disc 18 driven by shaft 20. In a conventional manner, the shafts 16,20, are supported within respective shaft housings 22,24, which sealingly penetrate opposite sides of the casing along a common axis 26 of disc rotation. In this manner, the refining process within the casing 12 can be accomplished at superatmospheric pressure and temperature. Each shaft is driven by its own motor (not shown) or other source of power which, for reasons to be described more fully below, should permit the independent setting of the equilibrium speed of rotation of one shaft 16 relative to the other 20.

Further in a manner known in this art, the right side of the refiner 10, or feed end, includes means 28, such as inlet nozzle 30 and feed screw 32 or the like, for introducing high consistency material to be refined into a throat region 34 in the hub 36 of the feed end disc 14, adjacent the axis of rotation at a variable pressure P1. It may be appreciated that, upon introduction into the feed space 38 between the discs, the material, such as wood chips, would as a result of centrifugal force move generally radially outwardly into an inner refining zone 40 defined between a first grinding plate 42 carried by the feed end disc 14, and a second grinding plate 44 carried by the control end disc 18. The first and second plates are arranged annularly around the respective feed end and control end discs, in confronting relation to each other.

Figure 3:
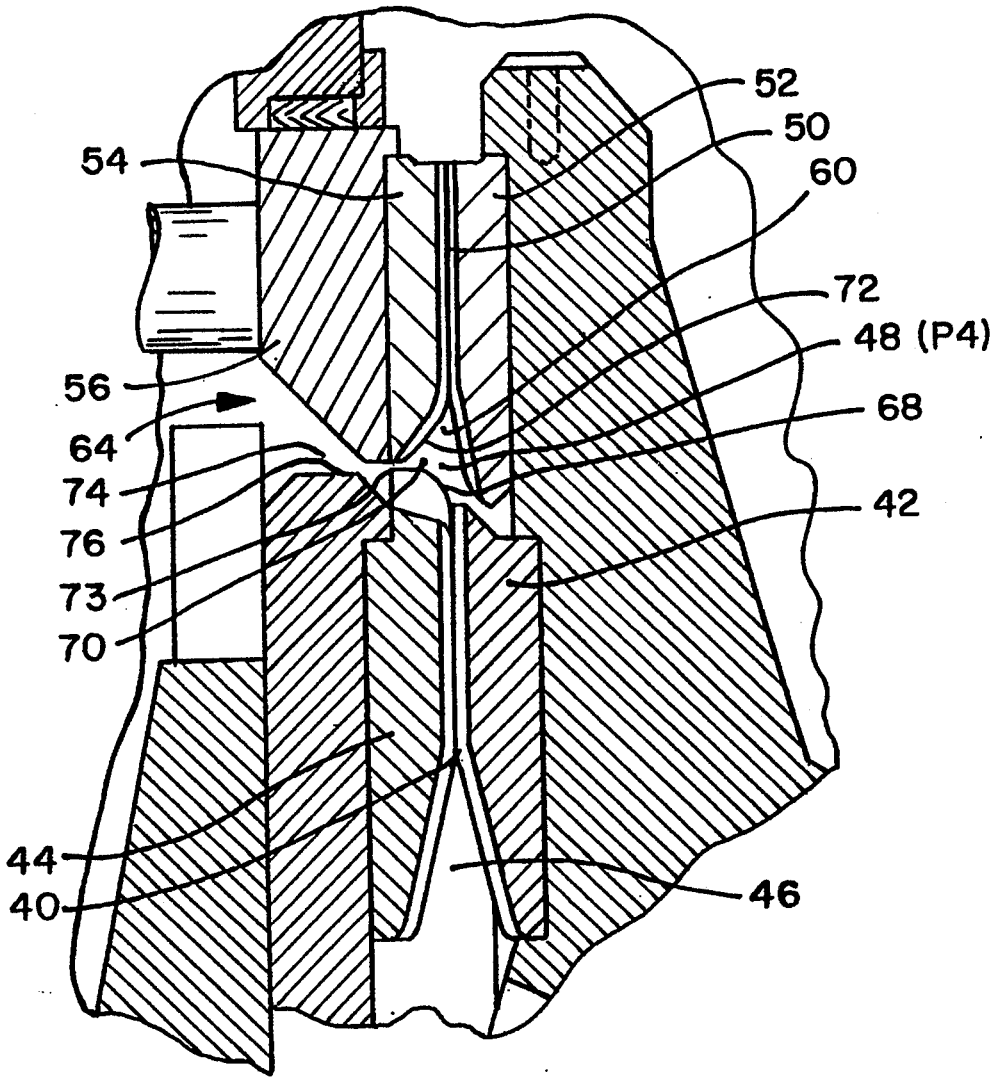
FIG. 3 is an englarged view of a portion of FIG. 1, showing the transition between the first and second refining zones.

As shown in FIGS. 1 and 3, the plates 42,44 define an inlet region 46 which captures and funnels the chips toward the active grinding surfaces between the plates. As the partially refined material continues to move generally radially outwardly, it is discharged from the inner refining zone 40 to a transition, or separation region 48.

A second, or outer refining zone 50, is situated generally radially outwardly relative to the inner refining zone 40, and includes a third plate 52 carried by the feed end disc, and a fourth plate 54 carried by a generally annular, stationary plate holder 56 which is supported by the casing as at 58, rather than by either of the rotating shafts 16,20. Thus, it may be appreciated that the feed end disc 14 has a larger diameter than the control end disc 18, because it carries the third plate 52 which annularly surrounds the first plate 42 on the feed end disc. The fourth plate 54 annularly surrounds the second plate 44, but is not carried by the control end disc 18.

The third and fourth plates 52,54 define another inlet region 60 substantially co-extensive with the transition, or discharge region 48 of the inner refining zone, such that the partially refined fibers that are discharged from the inner refining zone 40 are funneled inwardly so as to pass between the grinding surfaces defined by the third and fourth plates 52,54. The substantially fully refined pulp is then discharged at a pressure P2 through the discharge opening 62 in the casing 12.

As mentioned in the background portion of the present specification, the grinding of the chips and pulp produces considerable quantities of steam which, in general, adversely affects the refining process. In accordance with the present invention, a steam flow path 64 is established from the transition or separation region 48 between the inner and outer refining zones 40,50, to a steam discharge conduit or opening 66 in the casing, independent of the pulp discharge opening 62. By adjusting the pressure P3 in the steam discharge conduit 66, or elsewhere along the steam flow path 64, the pressure difference between the transition, or separation region 48 and the conduit 66 can be controlled. This pressure difference produces an axial force on the material in the transition region 48, in addition to the centrifugal force acting on the material due to the rotation of the discs. Because the steam is lighter than the pulp material and fibers, the steam is preferentially drawn through the steam path 64, and thereby separated from the pulp and fiber, the latter continuing to move in a generally radial direction into the second refining zone 50.

Figure 2:
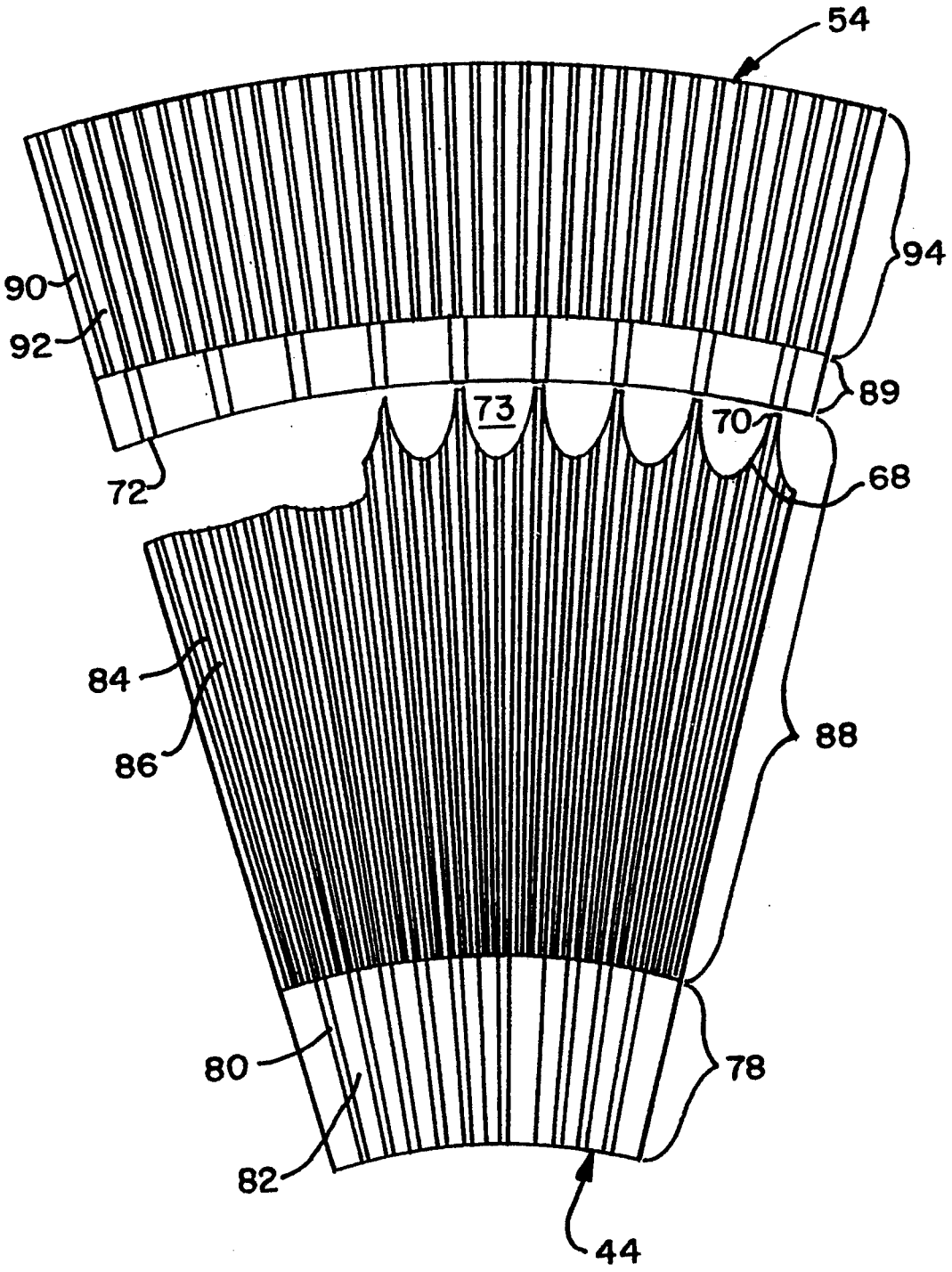
FIG. 2 is a frontal view of the relationship of the inner and outer plates on the control disc and stationary plate holder, respectively, as viewed along line 2—2 of FIG. 1.

FIG. 2, when viewed in conjunction with FIG. 3, shows that, preferably, the outer edge 68 of the plate 44 is scalloped. The radially outer portion of the blade 70 is at a distance from the axis that is only slightly less than that of the radially inner surface defined by opposed blades 72 of plate 54. The scalloped edge permits steam to travel axially whereas the blades 70 maintain the fibers on a generally radial trajectory. This helps assure that fibers discharged from the inner refining zone 40, although influenced to some extent by the axial force component induced by the pressure differential between region 48 and P3, will be captured by the radially inner surfaces of the third and fourth plates 52,54 that define the inlet 60 to the outer refining zone 50. The steam in the transition region 48, can more easily than the pulp or fibers, travel the path 73 from the transition region 48 to the annular space 74 between the circumferential periphery 76 of the control end disc 18, and the radially inner surface of the stationary plate holder 56.

The preferred form of the first and second plates 42, 44, includes radially inner portion 78 defining a series of relatively large (thick) bars 80 and grooves 82 which taper inwardly, thereby defining a funnel, or inlet 46. The inlet 60 is defined by the lower portion 89 of the third and fourth plates 52,54, which carries the spaced-apart, wide bars or blades 72.

The first and second plates have relatively fine, or closely spaced, bars 84 and grooves 86 along their radially outer portion 88, and similarly, the third and fourth plates 52,54 have relatively fine, closely spaced bars 90 and grooves 92 over the radially outer portion 94.

The preferred configuration of the inner and outer refining zones, as shown in FIG. 1, provides that the annular refining gap between the plates of the inner refining zone 40, is substantially coplanar with the annular gap between the plates in the outer refining zone 50. In other words, it is preferred that the inner and outer refining zones 40,50 be substantially coplanar, along a plane that is perpendicular to the axis of rotation 26.

It should be appreciated, however, that as used in this specification, the condition that the outer refining zone 50 is situated "generally radially outwardly" from the inner refining zone 40, includes configurations wherein the refining gaps are not coplanar. For example, the gaps could both be vertical but offset somewhat axially, or the gap of the outer refining zone 50 could be oriented somewhat obliquely to the gap 40 of the inner refining zone. The significant feature of the present invention, is that the inner and outer refining zones 40,50 are arranged with a transition region 48 between them, such that centrifugal force propels the partially refined material from the inner refining zone 40, through the transition region 48, into the outer refining zone 50 while the steam produced in the inner refining zone 40 is drawn from the transition region 48 so as not to enter the outer refining zone 50.

Even in the ideal configuration shown in FIG. 1, it is possible that some partially refined pulp or fiber material will be drawn through the steam bypass path 64 and thus have a chance to enter the space 96 behind the control disc 18, i.e., at the side of the control disc 18 opposite the first refining zone 40. To assure that such fibers are removed from the casing 12 and do not accumulate on the back side of the control disc, a plurality of radially extending vanes 98 are provided at the back side of the control disc 18, to propel such fibers radially outwardly and toward a collection chamber or channel 100 that is annularly disposed near the outer portion of the casing 12, and which is in fluid communication with the steam discharge conduit 66. This chamber collects steam as well as bypassed fibers.

The extent of pulp or fiber content in the steam bypass flow 64 will depend in large part on the kind of refining control that is implemented by adjustment of the relationship of pressures P1, P2, P3, and P4. This fine control is achieved with the present invention, as an overlay to the two-stage refining in which the first stage, inner refining zone 40 operates with low energy at high intensity, due to the counter-rotation and resulting high relative speeds between the first and second plates 42,44, and the second stage in the outer refining zone 50, where high energy, low intensity refining occurs due to the rotation of only the third plate 52 relative to the stationery fourth plate 54. As in conventional double-disc refiners, the control disc 18 is axially adjustable 102 relative to the feed end disc 14, and, in accordance with the present invention, the stationary plate holder 56 and therefore third plate 56 are axially adjustable 104 relative to the third plate 52 carried by the feed end disc 14.

As a further control option in accordance with the present invention, the relative speeds of the counter-rotating discs can be adjusted. Preferably, the feed end disc 14 is rotated at a conventional speed, such as 1500 rpm, whereas the control end disc 18 operates at a high speed, for example, 3000 rpm. The discs are preferably rotated so that one rotates at a speed that is between 25% and 100% greater than the other. The energy savings and other advantages resulting from the rotation of the two discs at significantly different equilibrium speeds, is more fully described in U.S. patent application Ser. No. 683,750, "Controlled Intensity High Speed Double Disc Refiner", filed Jan. 8, 1991 (now U.S. Pat. No. 5,167,373) the disclosure of which is hereby incorporated by reference, and which is assigned to the assignee of the present application. Similarly, the advantages of steam removal between multiple refining zones in a single or twin refiner are described in co-pending U.S. patent application Ser. No. 681,049, "Three Zone Multiple Intensity Refiner", filed Apr. 5, 1991, now U.S. Pat. No. 5,248,099 and assigned to the assignee of the present application, the disclosure of which is hereby also incorporated by reference.

The present invention for the first time, provides steam separation between distinct refining zones in a double disc refiner, with variable intensity control available from a variety of adjustment parameters including steam separation fraction and rotation speed differential between the counter-rotating discs.

We claim:

1. In a method of operating a high consistency pulp refiner of the type having a pressurized casing (12) containing opposed grinding discs (14,18) mounted for counter-rotation abut a common axis (26) and between which material to be refined is introduced near the axis so as to move generally radially outwardly through an inner refining zone (40) between the discs while producing steam as a result of the refining action, the partially refined material and steam then moving through a generally radially outer refining zone (50) between one (14) of the discs and a stationary grinding surface (54) situated generally radially outwardly of the other disc (18), whereupon the refined material and steam are discharged from the casing through a material outlet (62), wherein the improvement comprises:

removing from the casing, at least some of the steam generated in the inner refining zone (40), by discharging the removed steam from the casing through a dedicated steam discharge opening (66) other than said material outlet (62) before said generated steam enters the outer refining zone (50), wherein steam situated between the inner and outer refining zones is at a first pressure and the steam discharge opening is at a second pressure;

adjusting the second pressure during operation to control the amount of steam discharged from the casing as between the material discharge outlet (62) and the steam discharge opening (66); and rotating one disc at a constant speed different from the speed of rotation of the other disc.

2. The improved method of claim 1, wherein the step of removing steam includes inducing a substantially axial flow of the steam along the circumferential surface of the other disc (18), as the steam and material are discharged from the inner refining zone (40).

3. The improved method of claim 1, wherein the step of rotating includes rotating one disc at least 25% faster than the speed of the other disc.

4. The method of claim 3, wherein the step of rotating includes rotating one disc approximately twice as fast as the other disc.

5. The method of claim 4, wherein the first disc is a feed end disc (14) through which material to be refined is fed into the inner refining zone (40), wherein the other disc (18) is a control end disc adapted to be axially adjusted relative to the feed end disc, and wherein the step of rotating includes rotating the control end disc (18) at a speed which is at least 25% faster than the speed of rotation of the feed end disc (14).

6. In a high consistency pulp refiner of the type having a pressurized casing (12) containing opposed grinding discs (14,18) mounted for counter-rotation about a common axis (26) and between which material to be refined is introduced near the axis so as to move generally radially outwardly through an inner refining zone (40) between the discs while producing steam as a result of the refining action, the partially refined material and steam then moving through a generally radially outer refining zone (50) between one of the discs (14) and a stationary grinding surface (54) situated generally radially outwardly of the other disc (18), whereupon the refined material and steam are discharged from the casing through a material outlet (62), wherein the improvement comprises:

means (64) operative between said other disc (18) and said stationary grinding surface (54), for diverting steam produced in the inner refining zone away from the outer refining zone while the partially refined material moves from the inner refining zone to the outer refining zone;

said inner and outer refining zones (40,50) are substantially radially spaced apart and the space therebetween defines a transition region (48) which, during operation of the refiner, contains a mixture of partially refined pulp and steam at a first pressure (P4);

the material outlet (62) is at a second pressure (P2);

means (28) are provided for supplying high consistency feed material at a fourth pressure (P1), through the one disc (14) to the inner refining zone (40);

the means for diverting steam (64) includes means for defining a by pass flow path (73,74) from the transition region to a dedicated steam discharge opening (66) in the casing (12);

means are provided for establishing a third pressure (P3) in the steam discharge opening, that is lower than the pressure (P4) in the transition region (48); and means are provided for independently adjusting the pressure (P3) in the steam discharge opening (66) and at least one of said feed pressure (P1) and pulp outlet pressure (P2).

7. The improved refiner of claim 6, wherein the inner and outer refining zones are substantially coplanar as viewed in a first plane passing perpendicularly through the rotation axis.

8. The improved refiner of claim 6, wherein the inner refining zone (40) is defined by a pair of confronting first and second inner grinding plates (42,44), carried respectively by said one (14) and said other (18) discs, and the outer refining zone (50) is defined by a pair of confronting third and fourth grinding plates (52,54), said third plates (52) carried by said one disc (14) and said fourth plates (54) carried by a stationary plate holder (56) spaced from said other disc (18).

9. The improved refiner of claim 8, wherein the stationary plate holder (56) is in the form of a ring that is radially spaced from and circumscribes the other disc (18), thereby defining a substantially annular space (74) therebetween, said space forming a portion of said means (64) for removing steam.

10. The improved refiner of claim 6, wherein the means for diverting steam includes a collection chamber (100) in the casing and means for adjusting the pressure (P3) in the chamber.

11. In a high consistency pulp refiner of the type having a pressurized casing (12) containing opposed grinding discs (14,18) mounted for counter-rotation about a common axis (26) and between which material to be refined is introduced near the axis so as to move generally radially outwardly through an inner refining zone (40) between the discs while producing steam as a result of the refining action, the partially refined material and steam then moving through a generally radially outer refining zone (50) between one of the discs (14) and a stationary grinding surface (54) situated generally radially outwardly of the other disc (18), whereupon the refined material and steam are discharged from the casing through a material outlet (62), wherein the improvement comprises:

means (64) operative between said other disc (18) and said stationary grinding surface (54), for diverting steam produced in the inner refining zone away from the outer refining zone while the partially refined material moves from the inner refining zone to the outer refining zone; and said inner and outer refining zones (40,50) are substantially radially spaced apart and the space therebetween defines a transition region (48) which, during operation of the refiner, contains a mixture of partially refined pulp and steam; and said means (64) for diverting steam has an upstream portion (73) in fluid communication with said transition region (48) and a downstream portion (100) in fluid communication with a dedicated steam discharge opening (66) in the casing (12), other than said material outlet (62).

* * * * *

UNITED STATES PATENT AND TRADEMARK OFFICE

CERTIFICATE OF CORRECTION

PATENT NO. : 5,335,865
DATED : August 9, 1994
INVENTOR(S) : Gregory H. Kohler et al It is certified that error appears in the above-indentified patent and that said Letters Patent is hereby corrected as shown below:

Column 6, line 30, "abut" should be --about--.

Column 8, line 9, "plates" should be --plate--;
line 10, "plates" should be --plate--.

Signed and Sealed this

Thirty-first Day of December, 1996

*Attest:*

*Attesting Officer*

BRUCE LEHMAN

*Commissioner of Patents and Trademarks*